United States Patent [19]

Ingwersen et al.

[11] Patent Number: 5,017,078

[45] Date of Patent: May 21, 1991

[54] METHOD AND APPARATUS FOR UNLOADING COMPONENTS FROM TAPE CARRIER PACKAGING

[75] Inventors: Peter Ingwersen, Gilberts; Bernard M. West, Clarendon Hills, both of Ill.

[73] Assignee: Molex Incorporated, Lisle, Ill.

[21] Appl. No.: 471,996

[22] Filed: Jan. 24, 1990

[51] Int. Cl.[5] ..... B65B 69/00

[52] U.S. Cl. ..... 414/417; 221/25; 414/412; 414/786

[58] Field of Search ..... 414/412, 417, 786; 221/25, 30, 74; 83/111

[56] References Cited

U.S. PATENT DOCUMENTS

| | | | |
|---|---|---|---|
| 2,576,492 | 11/1951 | Vogel | 414/412 X |
| 3,487,965 | 1/1970 | Gale | 414/417 X |
| 3,590,481 | 7/1971 | Felty | 29/624 |
| 4,428,709 | 1/1984 | Peters | 414/412 |
| 4,503,607 | 3/1985 | Asai et al. | 29/832 |
| 4,583,641 | 4/1986 | Gelzer | 206/330 |
| 4,617,733 | 10/1986 | Olson | 29/874 |
| 4,621,486 | 11/1986 | Slavicek | 53/580 |
| 4,631,897 | 12/1986 | Slavicek | 53/399 |
| 4,712,675 | 12/1987 | Scholten et al. | 206/332 |
| 4,735,341 | 4/1988 | Hamilton et al. | 221/1 |
| 4,736,841 | 4/1988 | Kaneko et al. | 2206/332 |
| 4,738,386 | 4/1988 | Itemadani et al. | 226/52 |
| 4,740,136 | 4/1988 | Asai et al. | 414/787 |
| 4,756,073 | 7/1988 | Hawkswell | 29/564.6 |
| 4,763,780 | 8/1988 | Zebley et al. | 206/330 |
| 4,926,729 | 5/1990 | Igarashi | 414/412 X |
| 4,946,339 | 8/1990 | Berg et al. | 414/417 X |

FOREIGN PATENT DOCUMENTS

| | | | |
|---|---|---|---|
| 957717 | 2/1957 | Fed. Rep. of Germany | 221/74 |

*Primary Examiner*—David A. Bucci

*Attorney, Agent, or Firm*—Louis A. Hecht; Stephen Z. Weiss; A. A. Tirva

[57] ABSTRACT

A work station is disclosed for dispensing electrical components (12) from a tape carrier (10) having a plurality of spaced component-containing cavities (14). During the dispensing operation, one side wall (18') of the cavity is opened by slitting the tape carrier with a dual-blade knife structure (46), such that a component-ejecting shuttle mechanism (40) can pass through an opening (50) in the cavity and guide the component into a fixture (52). The knife structure includes two knife blades (102, 104) arranged such that a V-shaped notch (100) is formed by two inwardly-facing single-bevel knife edges (112, 114). The improved knife structure positions and slits the tape carrier at the notch without causing the tape to buckle or tear.

19 Claims, 5 Drawing Sheets

METHOD AND APPARATUS FOR UNLOADING COMPONENTS FROM TAPE CARRIER PACKAGING

CROSS-REFERENCE TO RELATED APPLICATION

This application contains subject matter related to U.S. Pat. No. 4,631,897, which is incorporated herein by reference.

BACKGROUND OF THE INVENTION

The present invention generally relates to an apparatus for unloading small, solid components from a flexible tape carrier packaging assembly having a plurality of cavities each containing at least one component. More particularly, the present invention is directed to a method and apparatus for dispensing electrical connectors individually from a tubular passageway in a tape carrier by cutting a sidewall of the passageway, to present the connector to a wire-nesting fixture.

One known flexible tape carrier packaging assembly and ejecting apparatus is described in U.S. Pat. No. 4,631,897. A plurality of solid components, such as electrical connectors or housings for electrical components, are contained within tubular passageways of the tape carrier. An actuator arm, which may be the armature of a solenoid, is extended to enter a passageway, thereby displacing and ejecting a component. The packaging assembly is advanced through the apparatus by means in the form of indexing apertures which are engaged by teeth of a drive wheel connected to a stepping motor. In this manner, the components can be unloaded from the tape carrier package for use in a work station.

For many applications, this known technique adequately serves the single purpose of dispensing the components from the tape carrier. However, other applications require that the component be guided immediately into a component-receiving fixture for subsequent automated assembly steps. For example, many types of electrical connectors must be directly guided from the tape carrier package into a wire nesting fixture, such that wires may be affixed automatically to the connector terminals. If the wire nesting fixture cannot be located in close proximity to the tape carrier unloading machine, the connector must be transported in some manner to the fixture.

It was found that if the length of the actuator arm was extended, it also could serve as a pusher rod to transport the connector into the fixture. However, if the fixture was located twelve or more inches from the side of the tape carrier, then the length of the pusher rod had to be increased by that distance in order to guide the connector into its fixture. Moreover, if small connectors were used in such an apparatus, the pusher rod had to be very thin such that it would pass through the narrow tubular passageway in the tape carrier. For example, one connector wiring application required the use of a one-eighth inch diameter rod of approximately sixteen inches long. Such a long, thin rod was hard to accurately position within the tubular passageway, and often would bend or break. Hence, prior tape carrier unloading machines required frequent maintenance and adjustment, and were generally unreliable.

In attempting to overcome this reliability problem, it was discovered that a short pusher rod could be used if part of the/tape carrier tubular passageway was opened or cut away. A short pusher rod, having a length approximating the width of the tape carrier package, could be affixed to a larger and more substantial shuttle mechanism. Once the component was pushed out of the tubular passageway, the opening in the tape carrier would allow the shuttle to be passed over or through the tape carrier. Thus, the same short pusher rod attached to the shuttle mechanism also could be used to guide the connector into the wiring fixture.

It was further discovered that the tape carrier cutting procedure could be performed simultaneously with the removal of the component, if a knife blade tip were affixed to the shuttle mechanism. As the component was ejected from the passageway, the knife blade tip would slit the upper portion of the tape carrier in the same shuttle movement—thus permitting the shuttle to pass through the opened passageway. Only the upper tape carrier sheet was cut, since the integrity of the lower sheet had to be maintained for advancing the tape carrier and/or disposing of it. This simultaneous ejecting and cutting operation allowed small connectors to be guided more effectively and accurately into the wiring fixture, which increased the reliability of the unloading machine by allowing the use of a short pusher rod.

However, it was found that the reliability of the machine was not increased as expected. The flexible tape carrier packaging assembly would frequently buckle, fold over, or tear during the slitting operation, thereby jamming the machine and often damaging the fragile connectors. The tape carrier buckling problem was much worse when new tape carrier materials, which are stronger yet thinner and more flexible, were used. The unloading machine was particularly unreliable when tape carriers were used.

A need, therefore, exists for providing a reliable and efficient technique for unloading components from tape carrier packaging assemblies.

SUMMARY OF THE INVENTION

Accordingly, an object of the present invention is to provide an improved method and means for dispensing components from a flexible tape carrier packaging assembly, such that the component readily can be used in subsequent manufacturing operations.

Another object of the invention is to provide an improved technique for removing electrical connectors from a tape carrier, which solves the aforementioned tape carrier buckling problems.

These and other objects are achieved by the present invention which, briefly described, is a method and apparatus for dispensing components from a flexible carrier packaging assembly having a plurality of spaced-apart component-containing cavities. The apparatus comprises a drive mechanism for advancing the packaging assembly into a desired location, an actuator mechanism for ejecting the component from its cavity, and a dual knife blade structure, affixed to the actuator mechanism, for cutting at least one side of the cavity as the actuator ejects the component from the tape carrier. The knife structure is constructed such that at least two opposing knife edges face each other and form a notch. The edge of the tape carrier is cut by the knife structure at the notch during the component dispensing operation.

In the preferred embodiment of the present invention, a work station is adapted to unload electrical connectors from the tape carrier, and to guide them into an associated connector-receiving wiring fixture. A pair of drive rollers advance the tape carrier in a first direction until a particular connector-containing tubular passageway is positioned at a desired location. A rod member is affixed to a shuttle mechanism which ejects the connector in a second direction from the open-ended tubular passageway, and guides the connector into the fixture. The shuttle mechanism also includes an improved knife structure for cutting at least one side of the tubular passageway after the connector is at least partially ejected, such that the passageway does not prevent the shuttle from passing over the tape carrier. A control mechanism activates the shuttle and the drive mechanisms such that they cooperate to unload each connector from the packaging assembly and guide each one into the wiring fixture.

The knife structure of the preferred embodiment is comprised of two knife blades affixed in substantially the same plane and arranged back-to-back such that a V-shaped notch structure is formed by two inwardly-facing knife blade edges. The knife blades are constructed with single-bevel knife edges, wherein the bevels face away from each other such that no gap exists between the knife edges at the notch. As the rod member pushes the connector out of the tubular passageway, the knife structure positions and cuts at least one sheet of the tape carrier at the notch to open the tubular passageway and allow the shuttle to pass therethrough. The knife structure of the present invention slits the tape carrier without causing it to buckle or tear. Thus, the reliability of the work station is considerably enhanced.

BRIEF DESCRIPTION OF THE DRAWINGS

The features of the present invention which are believed to be novel are set forth with particularity in the appended claims. The invention together with further objects and advantages thereof, may best be understood by reference to the following description taken in conjunction with the accompanying drawings, in the several figures of which like-referenced numerals identify like elements, and in which:

DETAILED DESCRIPTION OF THE PREFERRED EMBODIMENT

Figure 1:
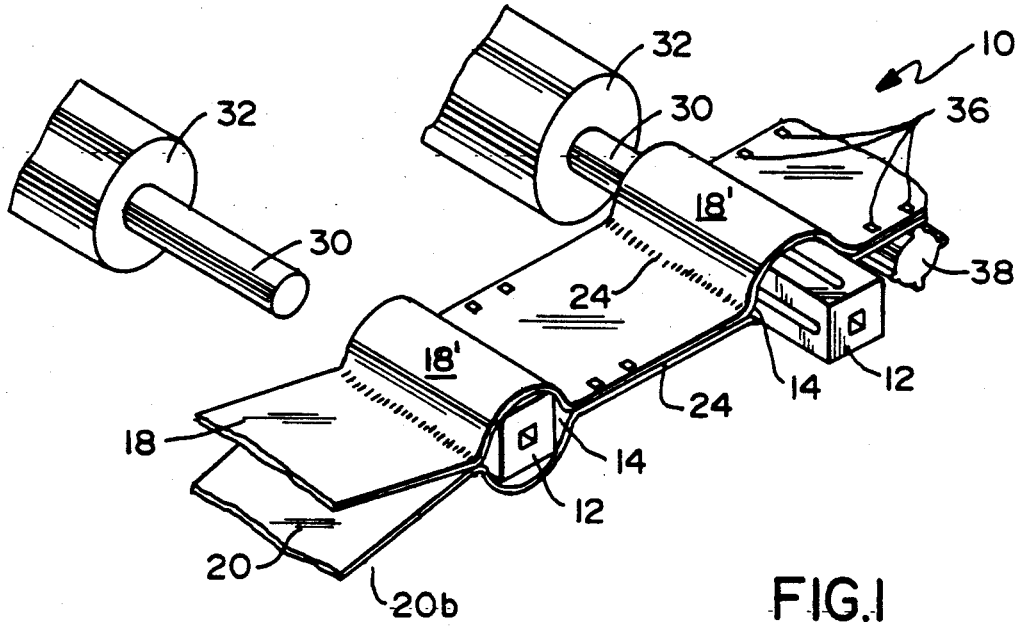
FIG.1 PRIOR ART
FIG. 1 is a perspective view of a flexible tape carrier assembly and an unloading mechanism according to the prior art.

FIG. 1 illustrates a perspective view of a flexible tape carrier packaging assembly, generally designated 10, used with the present invention, which is shown with the prior art ejecting apparatus described in U.S. Pat. No. 4,631,897. Solid components 12 are contained within tubular passageways 14 of a tape carrier. Actuator arms 30, i.e., the armatures of solenoids 32, are extended to enter passageway 14, thereby displacing and ejecting component 12. Packaging assembly 10 is comprised of two aligned, continuous flexible sheets 18 and 20, which are joined to each other along seam lines 24. Sheets 18, 20 may be formed of any flexible material such as MYLAR material, polyethylene, polyvinyl chloride, or even paper. The packaging assembly is advanced through the apparatus using indexing apertures 36 and drive wheel 38.

Figure 2:
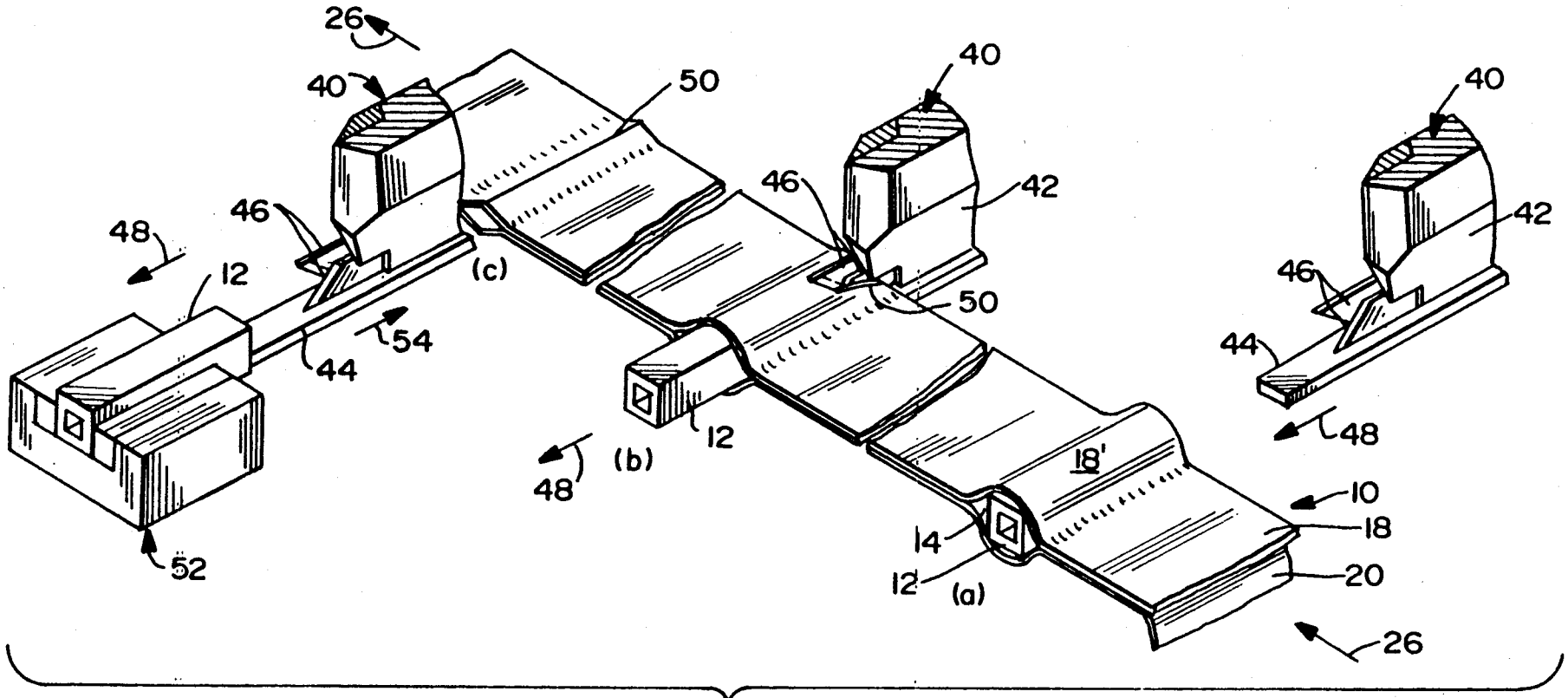
FIG. 2 is a perspective view of the flexible tape carrier unloading mechanism in accordance with the present invention.

Referring now to FIG. 2, the operation of the tape carrier unloading apparatus of the present invention is illustrated in three steps (a), (b), and (c). In step (a), flexible packaging assembly 10, containing a solid component 12 within an open-ended cavity or tubular passageway 14, is advanced in a first direction 26 along the longitudinal axis of the tape carrier. A shuttle mechanism 40, which serves to unload component 12 from its cavity in the tape carrier, is comprised of a shuttle base 42, a knife structure 46, and a pusher rod 44. When shuttle 40 moves in a second direction 48, perpendicular to first direction 26, pusher rod 44 is inserted within the open end of tape carrier cavity 14, and engages the rearward exposed face of component 12.

Step (b) of FIG. 2 shows that upper sheet 18 of the tape carrier is cut as shuttle 40 continues to push the component 12 out of its cavity. Note that since only an upper side wall 18' of the cavity is slit, the integrity of the tubular passageway 14 is maintained until at least a substantial portion of the body of component 12 has been ejected from the cavity—thus assisting in guiding the component in direction 48. For this reason, it is recommended that the length of pusher rod 44 be at least equal to the approximate width of tape carrier 10.

Finally, step (c) of FIG. 2 illustrates that the shuttle has passed through a slit 50 in the upper cavity wall and has proceeded in direction 48 to guide component 12 into a component-receiving fixture 52. Note that if knife structure 46 was absent, shuttle 40 could not pass over or through tape carrier 10. After component 12 has been guided into the fixture, the shuttle returns in direction 54. On the return stroke, shuttle 40 either may pass through slit 50 in the tape carrier, or, if the tape carrier is advanced one-half the distance to the next cavity, the shuttle would pass over it.

Figure 3:
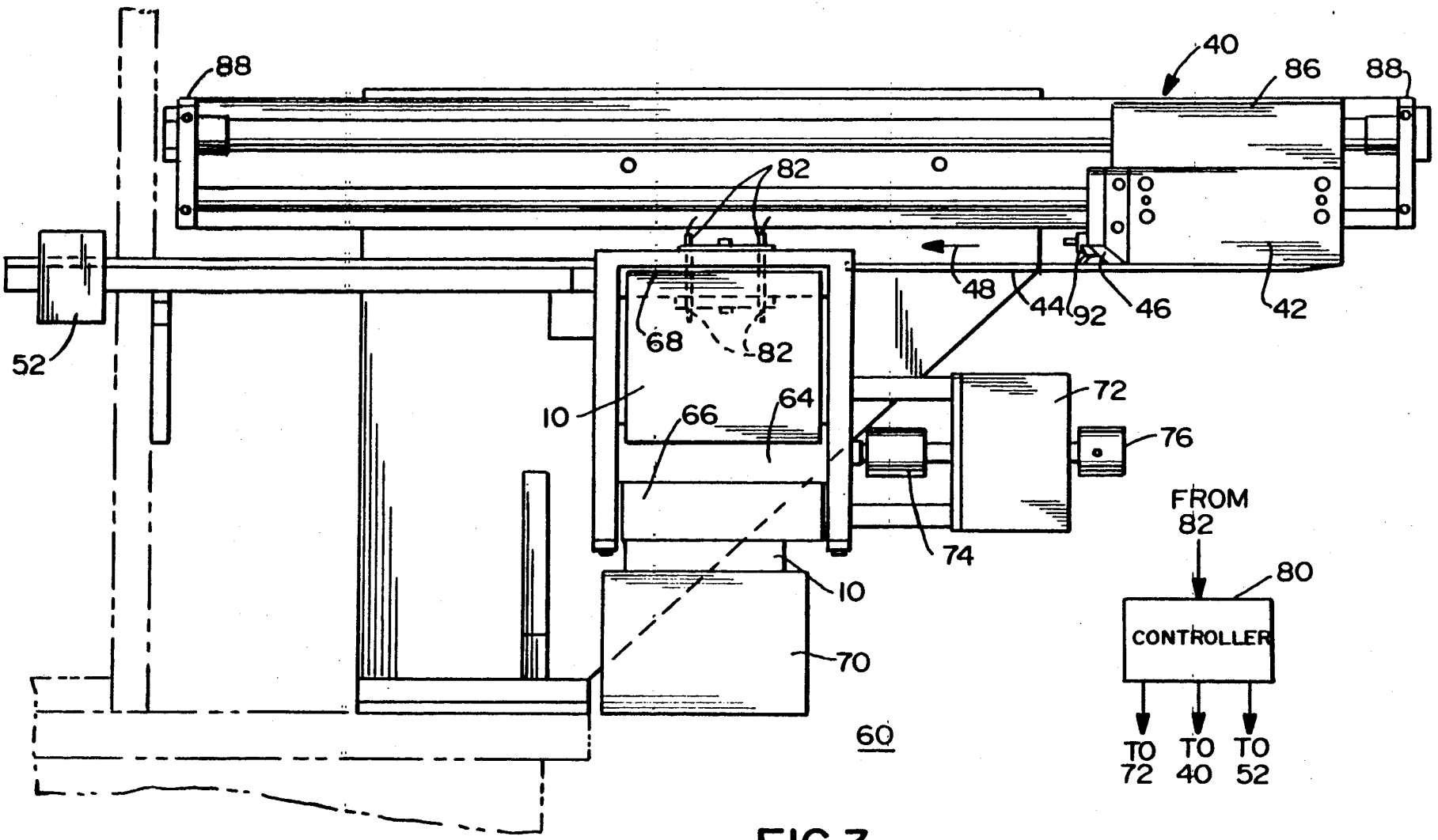
FIG. 3 is a front elevational view of the component unloading work station in accordance with the present invention.
Figure 4:
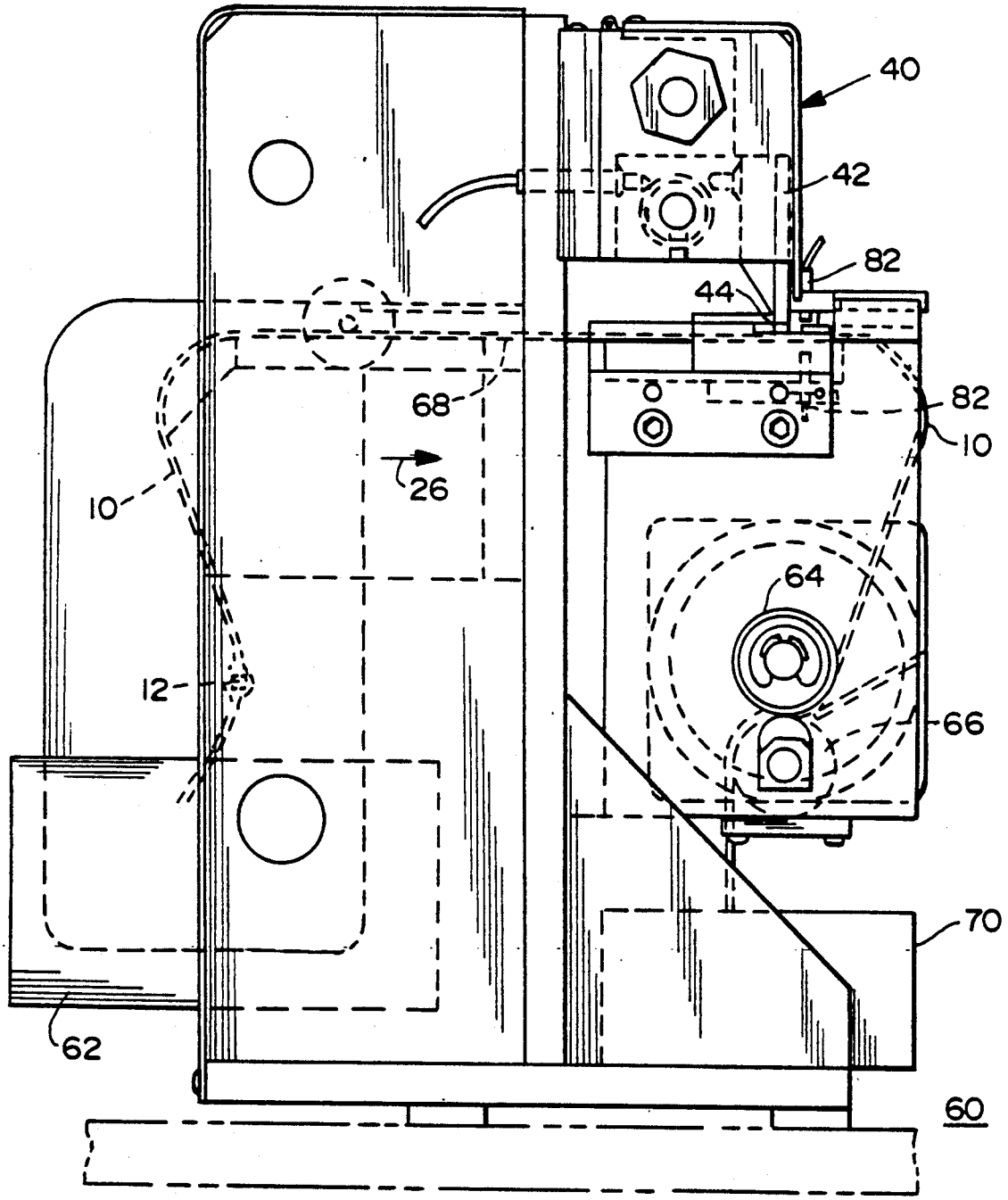
FIG. 4 is an end elevational view of the work station of FIG. 3.

FIGS. 3 and 4 illustrate front and end elevational views, respectively, of a work station 60 adapted to unload electronic components from a flexible tape carrier packaging assembly. The elements of the work station now will be described in terms of their functions performed during the tape carrier unloading operation.

Tape carrier 10, which contains components 12, is supplied from a source 62 such as a box or a reel. The tape carrier is advanced through the work station in direction 26 which, in FIG. 4, is from left to right as shown, and which would be pointing directly out of the view of FIG. 3. A drive roller 64 and an idler roller 66 advance the tape carrier through the machine and across a tape carrier bed 68, whereby the empty tape carrier may be collected in a receptacle 70. Drive roller 64 is connected to a stepping motor 72 via a coupler 74, which compensates for possible misalignments. A knob 76 provides for manual advancement of the tape carrier during initial set-up of the work station. A controller 80 interfaces and controls stepping motor 72, shuttle mechanism 40, and possibly fixture 52, in response to inputs from a photosensor device 82, as is known in the art.

Figure 5:
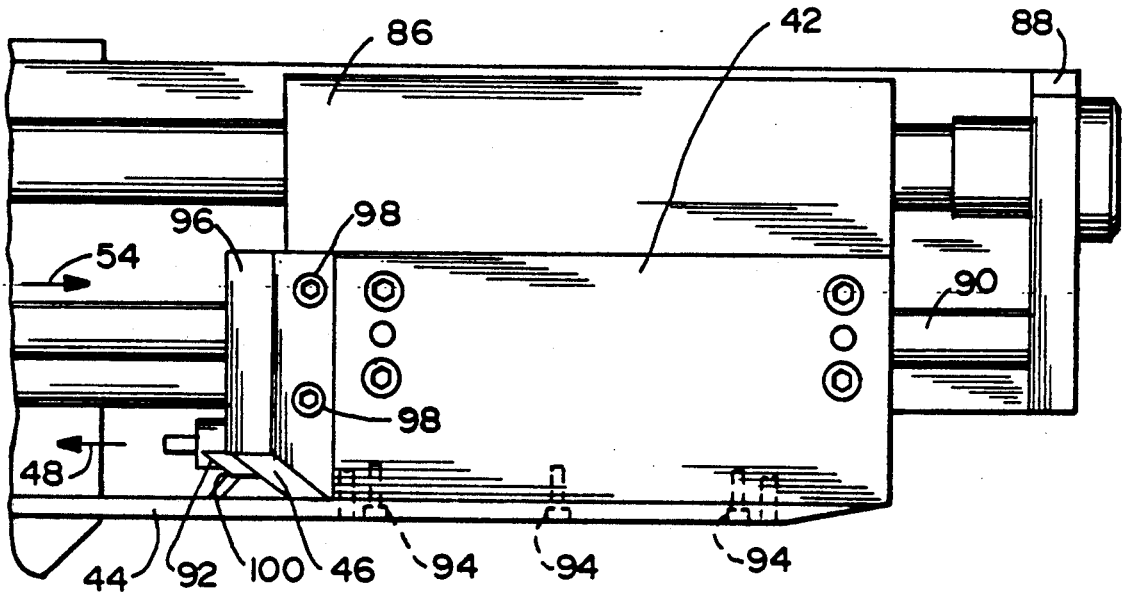
FIG. 5 is an exploded front elevational view of the shuttle mechanism of FIG. 3.

FIG. 5 illustrates an exploded view of shuttle mechanism 40. A rodless air cylinder 86 moves the shuttle in direction 48 toward the tape carrier to unload and guide the component into the fixture, and moves the shuttle in direction 54 on its return stroke. End plates 88, a guide rod 90, and a shock absorber 92 are used in conjunction with controller 80 to limit the back-and-forth movement of the shuttle. Pusher rod 44 is affixed to shuttle base 42 via screws 94. Knife structure 46, which will be described in more detail in the following figure, is affixed to shuttle base 42 via a knife clamp 96 and clamp screws 98. A V-shaped notch structure 100 is formed by two inwardly-facing knife blade edges.

Figure 6:
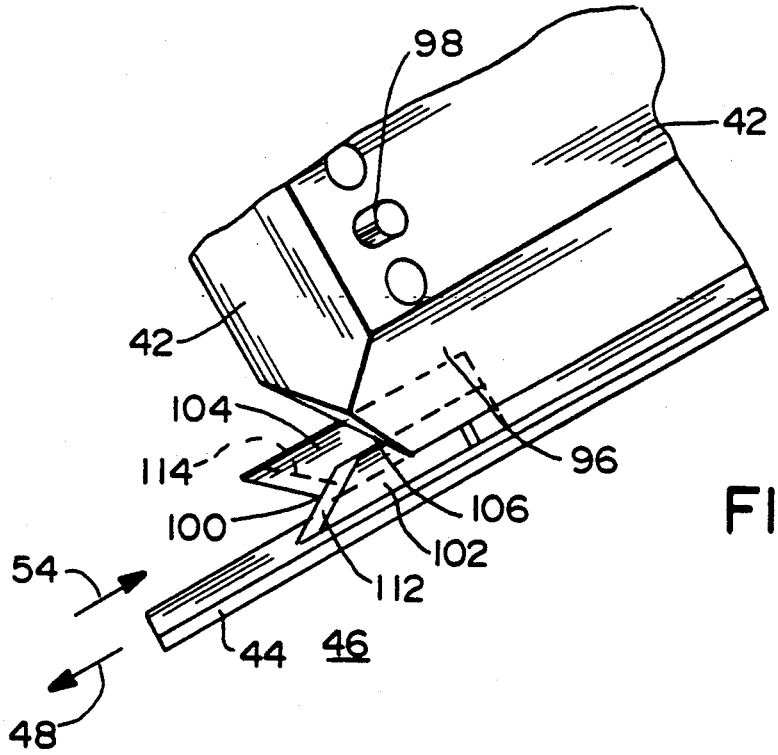
FIG. 6 is a perspective view of the shuttle mechanism of FIG. 5, illustrating the beveled edges of the knife blades.

Referring now to FIG. 6, a perspective view of knife structure 46 is illustrated. In the preferred embodiment, knife structure 46 is comprised of two knife blades 102 and 104, which are affixed to shuttle base 42 via knife clamp 96 and clamp screws 98. Knife clamp 96 preferably has a bevel 106 on the forward edge to spread apart the tape carrier such that the shuttle may readily pass through the slit. Knife blade 102 should be in substantially the same plane and directly adjacent to knife blade 104. A bevel 112 on the forward cutting edge of knife blade 102 should be on a single side of the blade, i.e., the blade should not have a two-bevel knife edge. A bevel 114 of blade 104 is shown on the reverse side of blade 104, such that there is, for all practical purposes, no gap between blade 102 and blade 104 at notch 100. This gapless knife blade bevel configuration is important when tape carriers are used. If even a minor gap exists between blades 102 and 104 at notch 100, the tape will be caught between the blades, and will buckle, tear, and jam the machine.

Work station 60 dispenses components from tape carrier packaging assembly 10 and guides them into component receiving fixture 52 in accordance with the following operating steps:

(1) Controller 80 causes stepping motor 72 to advance tape carrier 10 in direction 26 to position a component-containing cavity on tape carrier bed 68 in line with pusher rod 44.

(2) The component is ejected from its cavity via pusher rod 44 when controller 80 activates air cylinder 86 to move shuttle mechanism 40 in direction 48.

(3) During the movement of shuttle 40 in direction 48, the edge of upper sheet 18 of tape carrier 10 moves into notch 100 of knife structure 46, and the upper side wall of tubular passageway 14 is slit as shuttle 40 continues in direction 48.

(4) The shuttle continues in direction 48 past tape carrier 10 to guide component 12 into fixture 52.

(5) Controller 80 causes shuttle 40 to move in direction 54 such that it returns to its original position, ready for the next component dispensing cycle.

In the preferred embodiment, a tape carrier 10 is used to store miniature electrical connectors, having very fragile terminals affixed thereto. Such a connector may measure ⅝ inch wide by 1 inch long by ⅛ inch high. The tape carrier is approximately 4 inches wide, and the tubular passageway is open only slightly more than ⅛ inch. Although the length of the pusher rod also is 4 inches, the wiring harness fixture is located approximately 18 inches away from the tape carrier bed. Succeeding connectors are spaced approximately 1 inch apart along the length of the tape carrier. The machine unloads approximately 300 connectors per hour. Accordingly, it now can be appreciated by those skilled in the art that the present invention solves a significant manufacturing problem, by efficiently and reliably dispensing small, fragile connectors into a distant wiring harness fixture.

Figure 7:
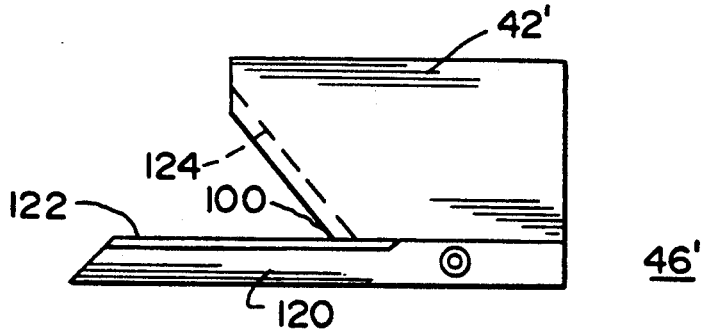
FIG. 7 is an elevational view of an alternative embodiment of a knife blade structure.

FIG. 7 illustrates an alternate embodiment of knife structure 46. In this embodiment, a shuttle base 42' has been constructed to serve the function of upper knife blade 104 of FIG. 6. A lower blade 120 has a bevel 122 facing in the opposite direction of a bevel 124 on shuttle base 42', such that there is no gap between the blades at notch 100.

Figure 8:
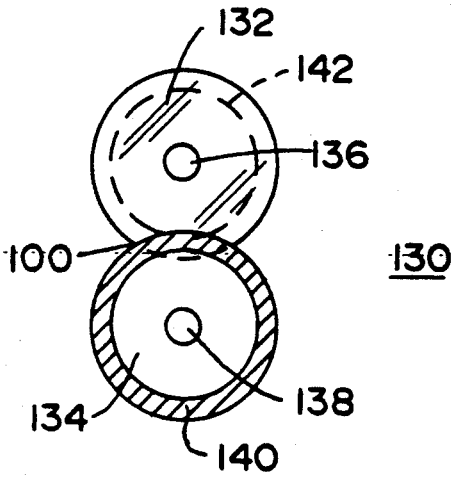
FIG. 8 is an elevational view of a further embodiment of a knife blade structure.

FIG. 8 shows another embodiment of a knife structure that could be used with the present invention. A knife structure 130 is formed from two circular blades 132 and 134, which either freely turn about, or are driven by, center mounting posts 136 and 138, respectively. Again, note that only one side of each circular blade is beveled at 140 and 142, such that no gap exists between the blades at notch 100. Although the circular blades do not present a V-shaped profile, the precise cutting points of the blades as they engage the "planar" flexible sheet material is V-shaped in a tangential context. An alternative embodiment of knife structure 130 would be the combination of upper circular blade 132 of FIG. 8 with lower blade 120 of FIG. 7. Other dual-blade knife configurations are possible.

In review, a method and apparatus for dispensing components from a flexible tape carrier packaging assembly has been shown and described herein. During the dispensing operation, one wall of the container cavity is opened by slitting the tape carrier with a dual-blade knife structure, such that the component-ejecting shuttle mechanism can pass through the cavity. The knife structure is comprised of two knife blades constructed and arranged such that a V-shaped notch structure slits the flexible tape carrier without causing it to buckle or tear.

While specific embodiments of the present invention have been shown and described herein, further modifications and improvements may be made without departing from the invention and its broader aspects. For example, any type of flexible or inflexible component carrier packaging may be used with the unloading technique described herein. It is contemplated that the knife blade structure of the present invention also could be used to pierce and open an enclosed pocket of a tape carrier, such that a vaccuum-operated pick-and-place machine could remove a chip component. Moreover, different types of knife blades, notch structures, or bevel configurations may be used to achieve the same goal of cutting one or more sheets of the tape carrier without buckling or tearing. All such modifications which retain the basic underlying principles disclosed and claimed herein are within the scope of this invention.

What is claimed is:

1. An apparatus for dispensing components from a packing assembly having a plurality of component-containing cavities constructed as open-ended tube-like passageways, said apparatus comprising:

actuator means for ejecting said component from its cavity; and knife means coupled to said actuator means for cutting at least one side of said cavity as said component is ejected, said knife means having a notch structure formed by at least two opposing knife edges, whereby said knife means cuts said packaging assembly at said notch structure during the component dispensing operation.

2. The component dispensing apparatus according to claim 1 wherein said packaging assembly comprises a flexible tape carrier.

3. The component dispensing apparatus according to claim 2 wherein said flexible tape carrier is constructed of MYLAR material.

4. The component dispensing apparatus according to claim 1 further comprising drive means for advancing said packaging assembly in a first direction until a particular component-containing cavity is positioned at a desired location.

5. The component dispensing apparatus according to claim 4 wherein said actuator means includes means for ejecting said component in a second direction substantially perpendicular to said first direction.

6. The component dispensing apparatus according to claim 1 wherein said knife means comprises two knife blades affixed in substantially the same plane and arranged such that a V-shaped notch structure is formed by two inwardly-facing knife edges.

7. The component dispensing apparatus according to claim 6 wherein each of said two knife blades has a single-beveled edge, each beveled edge facing away from the other knife blade such that no gap exists between the two knife blade edges at said V-shaped notch.

8. The component dispensing apparatus according to claim 1 wherein said actuator means includes a rod means for pushing said component substantially out of said component-containing cavity before said cavity is cut.

9. The component dispensing apparatus according to claim 8 wherein the length of said rod means is less than twice the length of said component-containing cavities.

10. The component dispensing apparatus according to claim 1 further comprising fixture means for receiving said component after it is dispensed from said packaging assembly.

11. The component dispensing apparatus according to claim 10 wherein said fixture means is located at least twelve inches from said packaging assembly during the dispensing operation.

12. The component dispensing apparatus according to claim 1 wherein said knife means comprises two knife blades, at least one being constructed as a circular disk, said knife blades being affixed in substantially the same plane and arranged such that a V-shaped notch structure is formed at their overlapping blade edges.

13. A method of dispensing a component from a flexible tape carrier packaging assembly having a plurality of component-containing cavities, each cavity having at least one flexible sidewall, said method comprising the steps of:

(a) advancing said tape carrier in a first direction until a particular component-containing cavity is adjacent a notch structure formed by at least two inwardly-facing knife blades of a shuttle member having dimensions larger than said component;

(b) ejecting said component at least partially from its cavity;

(c) opening said flexible sidewall by cutting said tape carrier at said notch structure using said knife blades; and (d) passing at least a portion of said shuttle member through the opening in said flexible sidewall.

14. The method according to claim 13 further comprising the step of guiding said component into a component-receiving fixture.

15. The method according to claim 13 wherein said component-containing cavities are constructed as tube-like passageways having at least one open end, and including the step of positioning an edge of said flexible cavity sidewall at said open end into said notch structure.

16. A work station adapted to unload electronic components from a flexible tape carrier packaging assembly into a component-receiving fixture, said packaging assembly having a plurality of spaced-apart open-ended component-containing tubular passageways, said work station comprising:

drive means for advancing said packaging assembly in a first direction until a particular component-containing tubular passageway is positioned at a desired location;

shuttle means for unloading said component from said packaging assembly, and for guiding said component into said component-receiving fixture, including rod means for pushing said component out of said tubular passageway and into said component-receiving fixture, and knife means for cutting at least one side of said tubular passageway as said rod means pushes said component out of said tubular passageway, said knife means comprising two knife blades affixed in substantially the same plane and arranged such that a V-shaped notch structure is formed by two inwardly-facing knife edges thereof; and control means for activating said shuttle means and said drive means such that they cooperate to unload each component from said packaging assembly by positioning and cutting said flexible carrier at said notch structure without causing said flexible carrier to buckle.

17. The work station according to claim 16, wherein each of said two knife blades has a single-beveled edge, each beveled edge facing away from the other knife blade such that no gap exists between the two knife blade edges at said V-shaped notch.

18. The work station according to claim 16 wherein said component-receiving fixture is located at least twelve inches from said desired location, and wherein the length of said rod means is less than six inches.

19. The work station according to claim 16 wherein said electronic components are electrical connectors having fragile terminals affixed thereto, and wherein said component-receiving fixture is part of a wire nesting machine.

* * * * *